United States Patent [19]

Boehling

[11] 4,373,484

[45] Feb. 15, 1983

[54] ROTARY PISTON MECHANISM

[76] Inventor: Daniel E. Boehling, 2341 Castlebridge Rd., Midlothian, Va. 23113

[21] Appl. No.: 194,190

[22] Filed: Oct. 6, 1980

[51] Int. Cl.[3] ..... F02B 53/02

[52] U.S. Cl. ..... 123/241; 418/61 R; 418/196

[58] Field of Search ..... 123/241, 242; 418/61 R, 418/58, 196, 165

[56] References Cited

U.S. PATENT DOCUMENTS

| | | | |
|---|---|---|---|
| 165,528 | 7/1875 | Barber | 418/165 |
| 1,831,263 | 11/1931 | Ross | 123/241 |
| 3,207,425 | 9/1965 | Morse | 418/58 |
| 3,799,126 | 3/1974 | Park | 418/196 |
| 3,996,901 | 12/1976 | Gale et al. | 123/242 |

*Primary Examiner*—Craig R. Feinberg
*Attorney, Agent, or Firm*—Norman B. Rainer

[57] ABSTRACT

A stator enclosure bounded by two side plates confines three fixed blocks and rotor components comprising an internal ring eccentrically disposed about a centrally positioned power delivery shaft which emerges from said enclosure, an outer floating ring which encompasses said blocks, and three identical and equidistantly spaced elliptic plates adapted to rotate about their centers. Rotation of said elliptic plates achieves tangential rolling contact with said internal and outer rings to form three chambers whose volumes vary with rotational displacement of said rotor components. Ports associated with said side plates enable gases to enter and exit said three chambers.

8 Claims, 5 Drawing Figures

ROTARY PISTON MECHANISM

BACKGROUND OF THE INVENTION

This invention relates to rotary piston mechanisms, and more particularly to such a mechanism for internal combustion engines, fluid motors, pumps and the like, wherein a rotating piston or rotor confined within a stationary enclosure moves eccentrically with respect to an output or an input drive shaft emanating therefrom.

Rotary piston internal combustion engines exemplified by the Wankel type engine have been designed in many variations. A general summary of such designs may be found in the book "Rotary Piston Machines", by Felix Wankel, published by Iliffe Books Ltd., London, 1965.

The Wankel type engine is generally comprised of a rotating member or rotor of uniform thickness having an outer periphery containing at least two apexes in outerwardmost extension from a center of symmetry, said rotor being housed within a stationary member or stator having two flat sides spaced apart sufficiently to accommodate the rotor, and a circuitous boundary wall perpendicular to said sides, said sides and boundary wall defining a gas-tight enclosure of fixed volume. In operation, the apexes of the rotor are in continuous sliding contact with said boundary wall, thereby defining a confined volume whose magnitude varies with different rotational positions of said rotor. The rotational variation of said confined volume, in association with properly placed ignition means and valves controlling the entrance of fuel vapor and exhaust of combustion gases, simulates the operation of a standard four cycle piston driven internal combustion engine, said cycles being intake, compression, ignition and exhaust. Although the rotary engine affords the inherent advantage of producing rotary torque power without using members undergoing reciprocating motion, difficulties are encountered in maintaining tightly sealed confined volumes. The factor most responsible for leakage is the sliding contact of the apexes of the rotor with the boundary wall of the stator. Said sliding contact also produces wear at the interactive sealing surfaces, said wear being particularly aggravated by the presence of valves in the boundary wall.

The replacement of the valves in the boundary wall with ports which penetrate the flat sides of the stator housing has been disclosed in U.S. Pat. No. 3,966,901 which relates to a rotary piston engine, the stator of which has three curvilinear boundary walls that make sliding contact with the two extremities of a single elongated rotor.

It is accordingly an object of this invention to provide a rotary piston mechanism which minimizes sliding contact between rotor means and other components interactive therewith to define within a stator enclosure confined volumes having magnitudes which vary with the rotational position of said rotor means.

It is another object of this invention to provide a rotary piston mechanism of the aforesaid nature wherein said rotor means is confined within a stator enclosure having two opposed flat sides.

It is a further object to provide a rotary piston mechanism of the aforesaid nature which provides for the controlled passage of gases to and from said confined volumes without employing valves having moving parts.

It is a still further object of this invention to provide a rotary piston mechanism as in the foregoing object capable of providing three power-imparting internal combustion firings within a 360° angular displacement of said rotor means.

These objects and other objects and advantages of the invention will be apparent from the following description.

SUMMARY OF THE INVENTION

The above and other beneficial objects and advantages are accomplished in accordance with the present invention by an improved rotary piston mechanism having stationary (stator) components, and rotary (rotor) components housed within said stator components. The stator is comprised of two side plates spaced apart by a circuitous flat boundary wall perpendicular to said plates to define an enclosure of fixed volume, and three filler blocks positioned within said enclosure. The configuration of said boundary wall is such that it possesses a center of symmetry and is generally convexly disposed with respect to said center of symmetry, a circular boundary wall being a preferred embodiment. Said blocks are in equiangular disposition with respect to said center of symmetry, their purpose being to occupy space within said enclosure and thereby improve the compression ratio of the mechanism, as will hereinafter be shown.

Rotor components disposed within said enclosure include a floating outer circular ring which encompasses said blocks, an internal ring, preferably of circular contour, adapted for eccentric rotation about said center of symmetry, and three elliptic plates which rotate about centered axles supported by said side plates. A power delivery shaft passes perpendicularly through both side plates at the center of symmetry. The thicknesses of said rotor components are substantially equal and uniform between opposed flat parallel faces, whereby tight-fitting engagement is secured with the side plates of said stator. The term "elliptic" is intended to denote ellipses, ovals, and other curvilinear shapes having two axes of symmetry which intersect at right angles, one axis of symmetry being greater than the other. The maximum radius of curvature of any portion of the periphery of the elliptic plates is less than the radius of curvature of the inside arcuate wall of the floating outer ring.

In operation, the arcuate edges of the rotating elliptic plates make rolling contact with said inside wall of the floating outer ring and the outer surface of said internal ring. Said contacts form chambers, whose volumes vary with rotational position and will hereinafter be referred to as chambers to distinguish over the fixed volume of the stator enclosure. The internal ring and the floating outer ring undergo eccentric motion of the same degree of eccentricity and 180 degrees out of phase with each other, thereby enabling the mechanism to be dynamically balanceable.

Whereas, in the conventional four-cycle, reciprocating piston internal combustion engine, the volumetric displacement on only one side of the piston is utilized, the present mechanism utilizes the volumetric displacement on both sides of the rotor components. In view of such mode of function, the three chambers of the present mechanism have the same power stroke displacement as a standard 6 cylinder engine. Because the chamber-forming contacts made by the elliptic plates are of a rolling rather than a sliding nature, frictional wear is minimized.

Apertures or ports are provided within said side plates to permit entrance or removal of gases to or from said chambers, said ports being symmetrically positioned with respect to the center of symmetry. Ignition means such as a spark plug may be associated with each chamber. Geared members adapted to synchronize the motion of the rotor components and/or adjust the contact pressure between interactive rotor components may be positioned outside the stator enclosure in rotative engagement with the power delivery shaft and the axles of the elliptic plates.

BRIEF DESCRIPTION OF THE DRAWINGS

For a fuller understanding of the nature and objects of the invention, referral should be had to the following detailed description taken in connection with the accompanying drawings forming a part of this specification and in which similar numerals of reference indicate corresponding parts in all the figures of the drawings.

DETAILED DESCRIPTION OF THE PREFERRED EMBODIMENT

Figure 1:
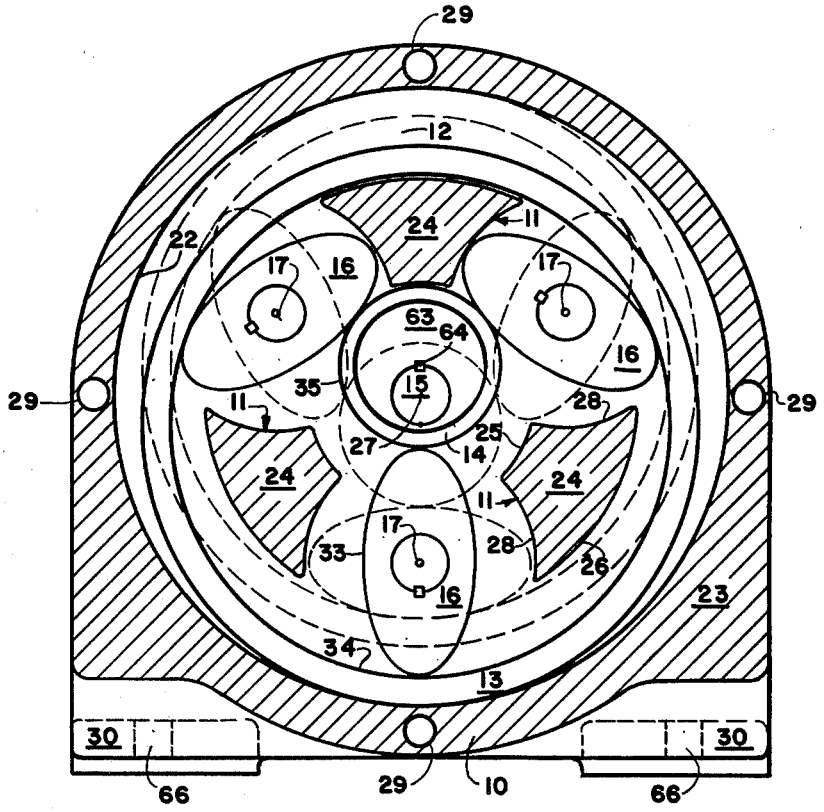
FIG. 1 is a vertical sectional view of an embodiment of the mechanism of this invention taken in a plane perpendicular to the power delivery shaft and showing the configuration of the rotor components in two different modes of their cyclic displacement.
Figure 2:
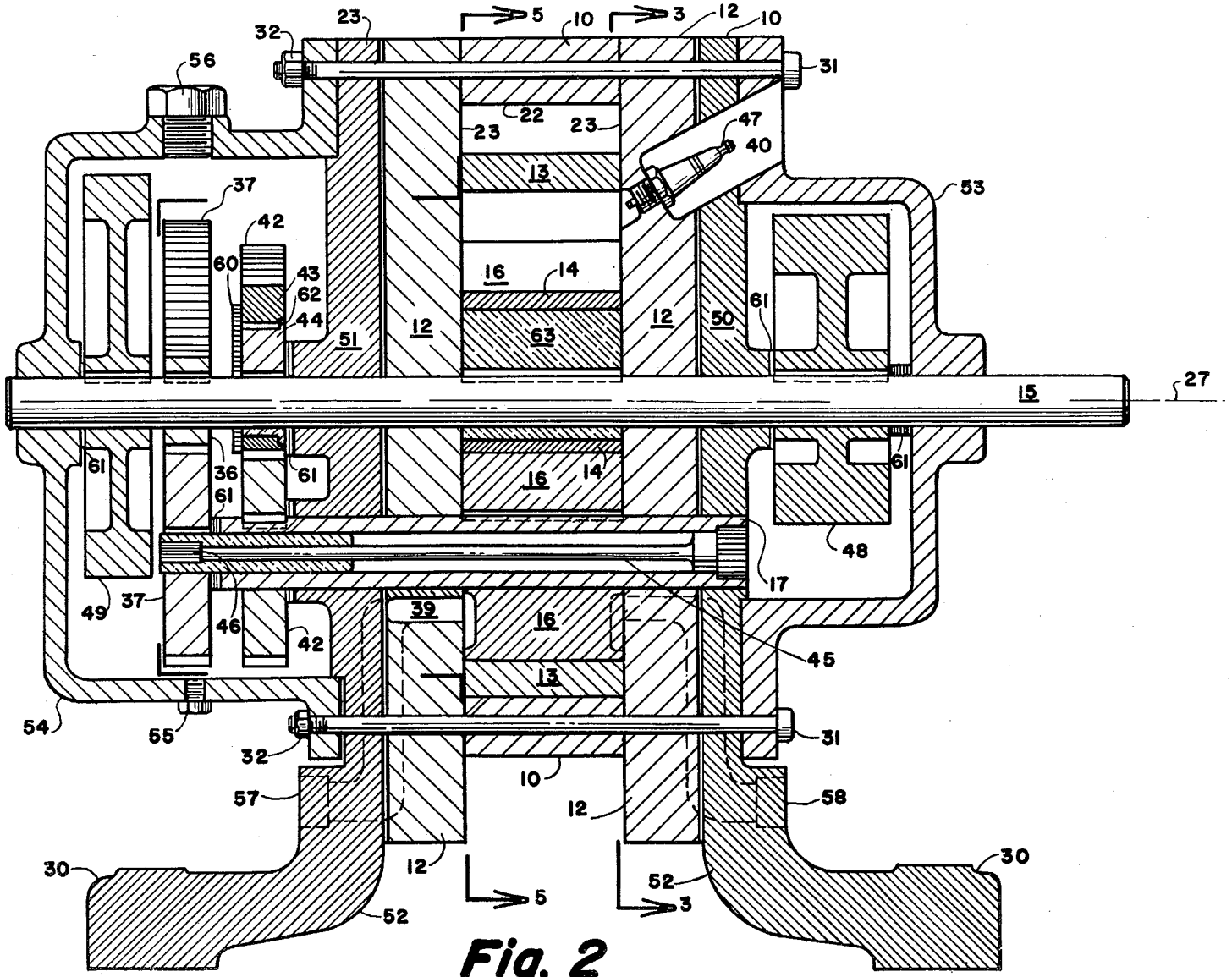
FIG. 2 is a vertical sectional view of the mechanism of FIG. 1 taken in a plane containing the axis of said power delivery shaft.

Referring to FIGS. 1 and 2, a stator assembly is shown comprised of housing 10 of uniform thickness having an internal cavity defined by circular boundary wall 22 disposed perpendicularly to the flat outer faces 23 of said housing, identical filler blocks 11, and flat side plates 12. Said blocks are defined by flat outer faces 24 and four arcuate edge walls, namely inner wall 25 and outer wall 26 configured as arcs of circles concentrically disposed about the center 27 of boundary wall 22, and side walls 28 of identical opposed curvilinear configuration. The blocks are disposed at 120° intervals about center 27 in a manner such that planes perpendicular to said stator assembly and including the radius lines at 120° constitute planes of symmetry of said blocks. The outer walls 26 of the blocks are equidistantly spaced from circular boundary wall 22. Apertures 29 are positioned adjacent the extremities of housing 10 to facilitate assembly of the mechanism. Mounting means in the form of opposed Pads 30 adjacent the base of said housing permit attachment of the mechanism to a supporting structure using bolt channels 66.

As shown more clearly in FIG. 2, substantially flat side plates 12 are positioned on each side of housing 10 in gas-tight abutment with faces 23 thereof. Said gas-tight abutment may be assured by means of gaskets, sealants and the like. Interengagement of said side plates with housing 10 is achieved by bolts 31 which penetrate apertures 29 in said housing and matching apertures in other components to be described hereinafter, and threadedly engage nuts 32. The aforementioned stator components interact to define an enclosure of fixed volume within which the next described rotor components are operatively confined.

The rotor components, which undergo cyclic rotary motion within the stator enclosure, include floating outer circular ring 13, internal ring 14 adapted to move eccentrically about power delivery shaft 15, and elliptic plates 16 adapted to rotate about their centers on supporting axles 17 which are journalled to side plates 12 and extend toward the rear of the mechanism. The several rotor components have a substantially uniform thickness adapted to make close-fitting contact with abutting side plates 12. The arcuate boundary walls of the several rotor components are flat in the sense that they represent the locus of a straight line moved perpendicularly with respect to side plates 12. The axis of power delivery shaft 15 in the illustrated embodiment passes through center 27. The locus of the centers of axles 17 is a circle about center 27 having a radius extending substantially half way along side walls 28 of blocks 11. Each elliptic plate may be characterized as having perpendicularly intersecting major and minor axes. The major axis of each elliptic plate defines the diameter of its circle of rotation. The side walls 28 of said blocks are preferably contoured as arcs of said circles of rotation.

In operation, the arcuate boundary walls 33 of said elliptic plates make rolling contact with the inside boundary wall 34 of floating ring 13 and outer boundary wall 35 of internal ring 14. Said rolling contacts occur tangentially amongst the respective members, the locus of said tangential contact being a straight line perpendicular to side plates 12. Said contacts define chambers of variable volume. In the course of the rotative motion, the three elliptic plates turn in the same direction, whereas internal ring 14 and floating outer ring 13 rotate in opposite directions. Said internal ring may be attached to power delivery shaft 15 or may be disposed about said power delivery shaft as a floating ring in much the same manner as said outer floating ring. The circumference of the outer boundary wall of said internal ring may be greater or less than the perimeter of said elliptic plates, whereby said internal ring undergoes less or more than one revolution respectively for each revolution of said elliptic plates.

Figure 4:
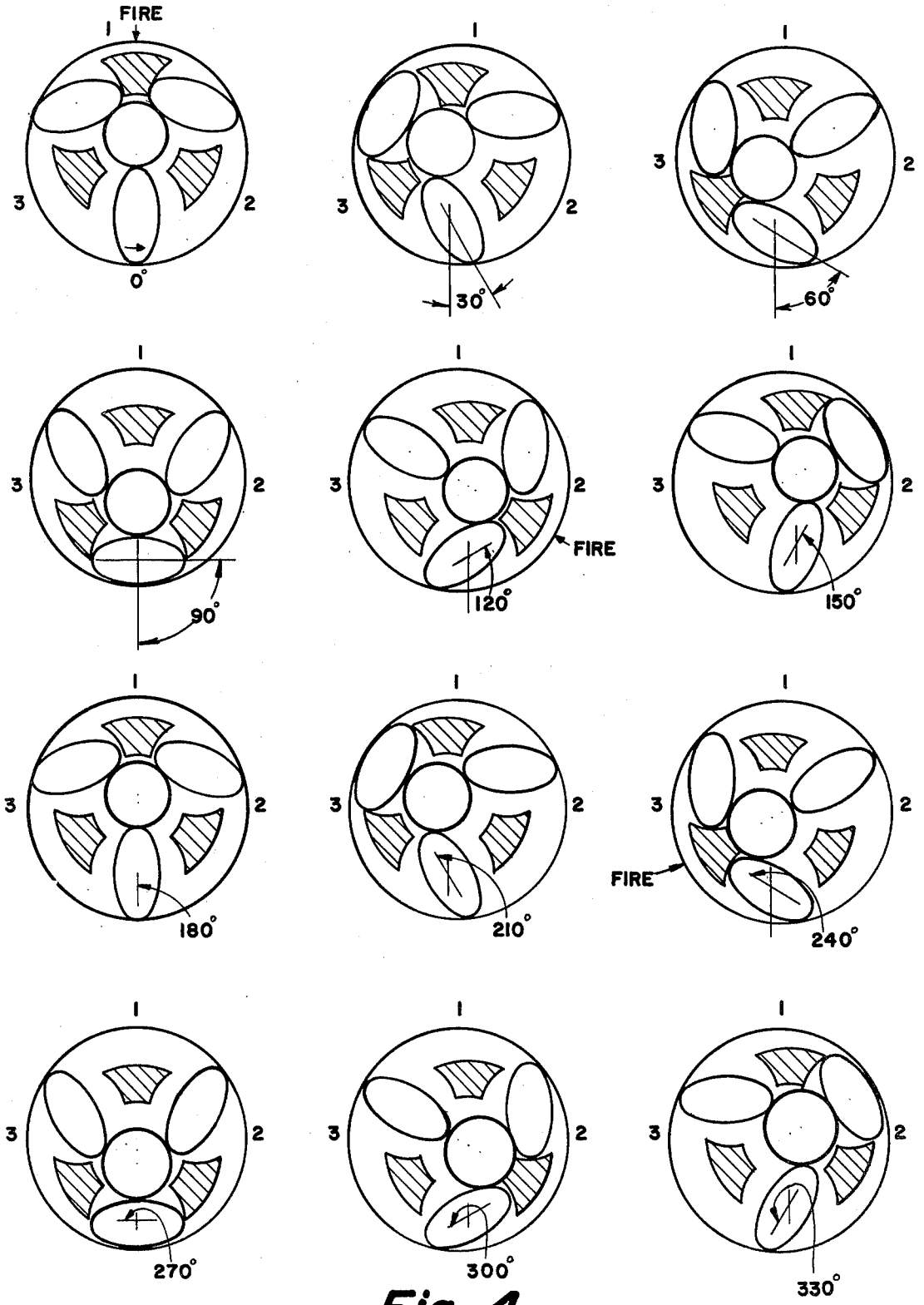
FIG. 4 shows schematically the interrelationships of stator and rotor components at different rotational positions within a single complete ignition cycle of the mechanism of this invention when used as an internal combustion engine.

The contacts and motion of the rotor members create three chambers of variable volume within the stator enclosure. The manner in which the volumes of said chambers vary with rotational motion, and the significance of said variation as applied to an internal combustion engine is demonstrated in the sequence of illustrations of FIG. 4. Said sequence is arranged in steps of 30° rotation, as may be most readily seen in observation of the position of the lowermost elliptic plate, it being understood however that all three elliptic plates, and the internal ring simultaneously undergo equal angular displacement. For ease of illustration, the uppermost chamber is designated chamber 1, the next clockwise adjacent chamber is designated chamber 2, and the next clockwise adjacent chamber is designated chamber 3.

In the 0° position, chamber 1 is at its minimum volume and, if containing a combustible vapor as in an internal combustion engine, is subjected to ignition by a spark plug or equivalent means. The force of the resultant explosion causes energy to be transmitted to internal ring 14 and elliptic plates 16, which transfer said energy to power delivery shaft 15 by means to be described hereinafter. In their motion, the elliptic plates in conjunction with outer ring 13 achieve a configuration at 90° angular displacement where chamber 1 has its maximum volume. At this point, an exhaust port, to be described hereinafter, opens to permit release of gas from chamber 1. At 180° of rotation, chamber 1 is again at its configuration of minimal volume, at which point said exhaust port closes and an intake port opens to permit entrance of combustible vapor into said chamber. At 270°, the volume of said chamber is again at its maximum, at which point the intake port closes and the sealed chamber commences a diminution of volume, thereby compressing the confined combustible vapor. At 360°, the cycle is completed as ignition occurs again.

Although the events in the course of a complete rotation of the elliptic plates have been described with respect to chamber 1, the same sequence occurs in chamber 2 at an angular interval 120° subsequent to chamber 1, and in chamber 3 at an angular interval 120° subsequent to chamber 2. In this manner, each of the three chambers undergoes the four cycles of an internal combustion engine, thereby providing the effect of three pistons equipped cylinders within a single complete 360° rotation of the elliptic plates. It will be noted from a perusal of the illustrations of FIG. 4 that the outer wall 26 of blocks 11 does not at any time contact the inside circular wall 34 of outer ring 13. In fact, none of said rotor components at any time contact any portion of said filler blocks. The positioning of said floating ring is determined by three sites of tangential contact with said elliptic plates. The closest approach of internal ring 14 to outer ring 13 occurs at 90° and 270° with respect to chamber 1, and the distance of said closest approach is substantially equal to the minor axis of said elliptic plates. Said positions of closest approach of said internal and outer rings also correspond to the positions of maximum volume of chamber 1. The space between outer ring 13 and boundary wall 22 of housing 10 may be provided with vanes which define chambers capable of precompressing gases to be led into the variable volume chambers within outer ring 13.

The manner whereby the filler blocks increase the compression ratio of the chambers of the mechanism may be explained as follows. The compression ratio (CR) is an expression of the volume of a chamber before displacement divided by the volume of the same chamber after displacement, and is mathematically expressed as:

$$\frac{V_1}{V_2} = CR$$

Wherein, $V_1$ is the large volume of a chamber before contraction, and $V_2$ is the volume after contraction. The insertion of a filler block of fixed volume $V_c$ into the chamber increases the compression ratio pursuant to the equation:

$$\frac{V_1 - V_c}{V_2 - V_c} = CR$$

To illustrate by assigning arbitrary values to the above-defined symbols, let $V_1=60$, $V_2=20$, and $V_c=15$. Then, in the original equation, CR=(60/20)=3:1, and in the latter equation, $$CR = \frac{60 - 15}{20 - 15} = \frac{45}{5} = 9{:}1.$$

The compression ratio may be further controlled by modifications in the shapes and dimensions of the rotor components.

Figure 5:
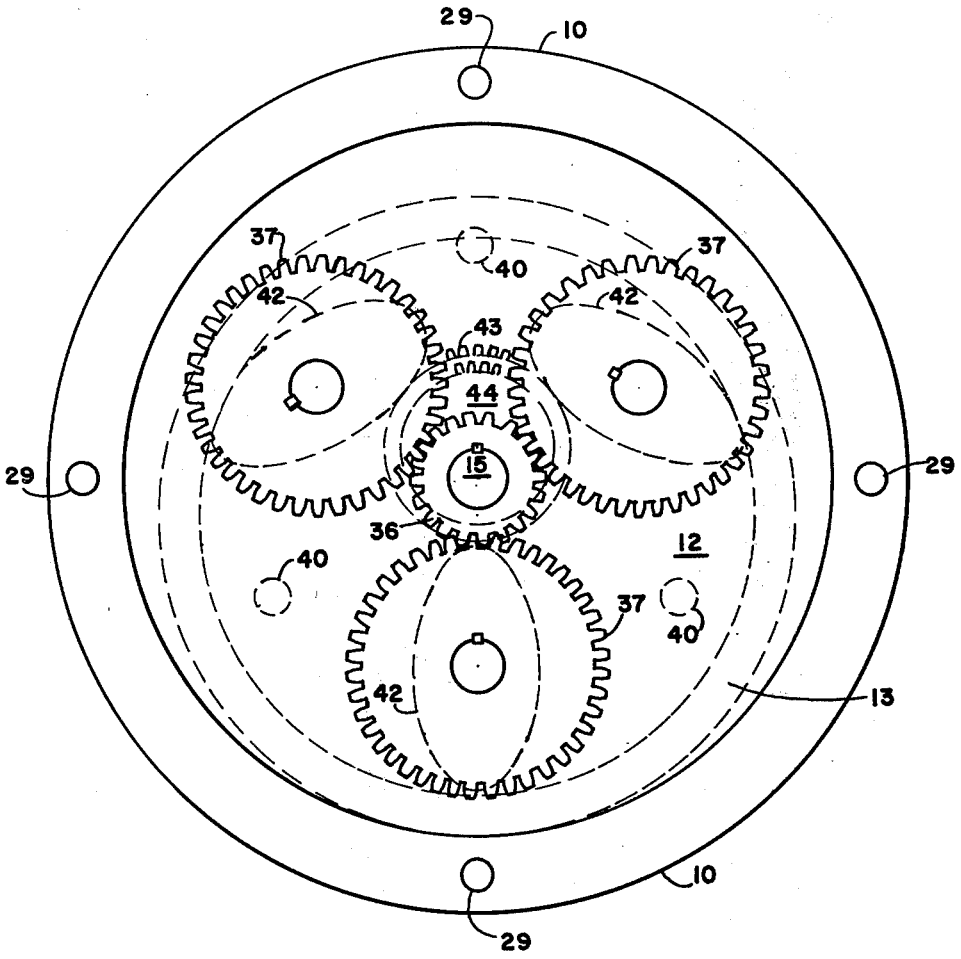
FIG. 5 is a vertical sectional view partly in elevation taken along the line 5—5 of FIG. 2.

Mechanical features exterior to the stator housing and shown in FIGS. 2 and 5 control: (a) the motion of the rotor components, (b) the magnitude of interactive contact pressures, and (c) the distribution of rotative energy (torque) emerging from said stator housing. Referring to FIGS. 2 and 5, each axle 17 is of tube-like construction, having a hollow cylindrical bore which houses a torsion shaft 45 whose function will be described hereinafter, and spline 46 positioned on torsion shaft 45 and protruding beyond one end of said axle. Center power take-off gear 36 keyed onto power delivery shaft 15 meshes with three identical circular torquing gears 37 keyed to the protruding portions of splines 46 and having twice the number of teeth as gear 36.

Elliptical timing gears 42 are keyed to axles 17 in adjacent association with each torquing gear 37, said elliptical timing gears 42 meshing with a center timing gear 43. When the embodiment of the mechanism involves attachment of internal ring 14 to power delivery shaft 15, a center timing eccentric 44 keyed to power delivery shaft 15 is positioned for epicyclic motion within center timing gear 43 which rotates at one half the rate of rotation of timing eccentric 44. The pitch diameter of gear 43 is the same as the outside diameter of internal ring 14, and both rotate at the same angular velocity. Gear 43 is sandwiched between retainer plate 60 bolted to eccentric 44 and retainer shoulder 62 integral with eccentric 44, such positioning of gear 43 serving to maintain it in alignment with eccentric 44.

Splines 46 transmit torsional forces from gears 37 through torsion shafts 45 to axles 17 which are affixed by keys to elliptical timing gears 42 and elliptic plates 16. The torsion shaft oscillates in a repeating pattern as gear 37 goes through constant angular displacement while timing gear 42 and elliptic plate 16 go through variable angular displacement repeating every 180° of angular displacement of gear 37.

The function of torsion shaft 45 is twofold, namely (a) to absorb the changes in angular velocity as each elliptic gear and plate rotates through 360°, and (b) by pre-loading, to produce the needed contact pressure between elliptic plates 16, floating outer ring 13, and internal ring 14.

Other features of the mechanism of this invention external to the stator housing include front and rear eccentric counterbalancing flywheels, 48 and 49 respectively, fixedly mounted on power delivery shaft 15 in a manner to provide centrifugal balancing compensation for the eccentric motion of certain parts described hereinafter. Frictionless spaces 61 are provided between certain moving and stationary parts. Front and rear housing plates, 50 and 51 respectively, may be provided to facilitate fabrication of the mechanism. The lowermost extremities of said front and rear housing plates may be provided with mounting bases 52 integrally associated therewith. Front and rear housing bells, 53 and 54 respectively, enclose certain rotating components of the mechanism. The rear housing bell serves further to confine lubricating oil intended to facilitate operation of the several above-mentioned gears, and is provided with a drain plug 55 and fill plug 56. A gas intake conduit 57 and gas exhaust conduit 58 are provided as passageways which enable gases to pass to and from the interior of said stator enclosure. Said passageways may traverse said housing plates and communicate with aperture ports 39 in side plates 12, as will hereinafter be shown.

Internal ring 14 is preferably affixed by hub 63 and keying means 64 to power delivery shaft 15. However, said internal ring may also be of the floating type, in which case the power take-off from the stator enclosure is by way of axles 17 through torquing gears 37 to center power take-off gear 36. In all instances however, power delivery shaft 15 will extend through the stator enclosure.

Figure 3:
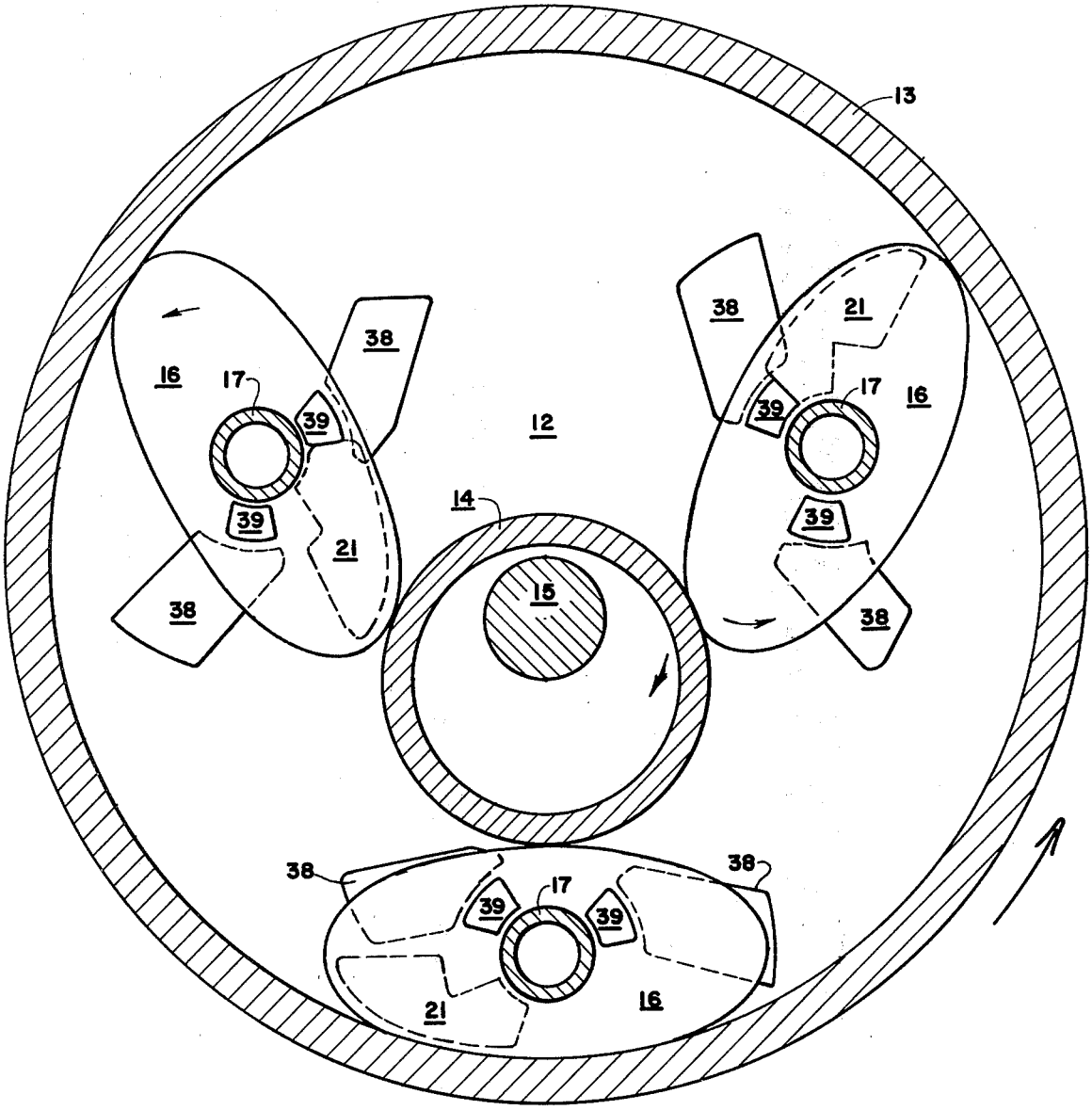
FIG. 3 is a vertical sectional view taken along the line 3—3 of FIG. 2.

The configurations of the exhaust channels are shown in FIG. 3. Said channels are comprised of grooves 21 recessed within the flat outer faces or "flanks" of elliptic plates 16 and associated grooves 38 recessed within the inner faces of side plates 12, said grooves 38 communicating with apertures 39 penetrating said side plates. In operation, the proper mating of moving grooves 21 with stationary grooves 38 establishes pathways communicating with the exterior of the stator enclosure. A similar arrangement of moving and stationary grooves is provided on the opposite flanks of said elliptic plates to serve as intake ports. The pathways communicating with intake and exhaust channels may be provided with conventional gas handling means. For example, in the case of an internal combustion engine, the exhaust channels will communicate with an exhaust manifold and associated muffler device, and the intake channels will communicate with an intake manifold supplied by a carburetor device. When the mechanism is used as a pump for gaseous or liquid materials, the exhaust line will correspond to the high pressure output of the mechanism. When used as a steam engine, the exhaust line will contain the spent or low pressure steam. Connection of said intake or exhaust manifolds to the stator may be achieved by appropriate fittings engaging conduits 57 and 58, the outer extremities of which are preferably threaded. As shown in FIG. 2, intake and exhaust manifolds service opposite side plates 12. Conventional spark plugs 47 may be made to threadably engage apertures in side plates 12.

The various components of the rotary mechanism of this invention are preferably fabricated of wear-resistent materials capable of being machine-fabricated to fine tolerances. Where necessary, special surface treatments may be utilized to minimize friction or wear, said surface treatments involving for example oxide or carbide coatings.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A rotary piston mechanism comprising:

a. a stator enclosure of fixed volume defined by two side plates spaced apart in gas-tight engagement with a circuitous boundary wall perpendicular to said plates, said boundary wall having a center of symmetry and being the interior portion of a housing of substantially uniform thickness having opposed flat outer faces, b. three filler blocks of substantially identical shape and volume fixedly positioned within said enclosure and spaced 120° apart with respect to said center of symmetry, said blocks having opposed flat outer faces and four edge walls perpendicular thereto, including inner and outer edge walls, said outer edge wall being further from said center of symmetry than said inner edge wall, and two side edge walls of identical opposed curvilinear contour, said blocks being symmetrical about a plane perpendicular to said outer faces and bisecting said inner and outer edge walls, c. rotor components disposed within said enclosure, said rotor components being of uniform thickness and having flat outer faces disposed to lie in close parallel association with said side plates, and having boundary edge walls perpendicular to said side plates, said rotor components comprising i. a floating outer ring having concentric inside and outside circular boundary walls, said ring encompassing said three blocks and adapted to undergo rotative motion in a manner eccentric to said center of symmetry, ii. an internal ring disposed about said center of symmetry and within an area bounded by said three filler blocks and adapted to undergo rotative motion in a manner eccentric to said center of symmetry and in a direction opposite to the motion of said outer ring, and iii. three identical elliptic plates, each located in spaces formed between respective filler blocks, and adapted for rotation about axles perpendicularly centered therein, said axles being supported by said side plates at sites between said blocks in a manner such that rotation of said elliptic plates causes continuous rolling contact with said internal ring and inside circular boundary wall of said outer ring, whereby when said elliptic plates are rotated in the same direction, three chambers of variable volume are defined within said outer ring, and none of said rotor components contact said filler blocks, d. a power delivery shaft which passes perpendicularly through said side plates at said center of symmetry, e. means for coupling at least one rotor component to said power delivery shaft, f. apertures positioned within said side plates to permit gas to enter and exit said chambers of variable volume, and g. grooves provided in the outer faces of said elliptic plates adapted to control the flow of gas from said chambers through said apertures.

2. The rotary piston mechanism of claim 1 adapted to function as an internal combustion engine having ignition means associated with each of said chambers to explode the gas confined therein, and wherein the force generated by said explosion is transmitted by at least one of said elliptic plates and internal ring to said power delivery shaft.

3. The rotary piston mechanism of claim 1 wherein eccentrically mounted flywheels are positioned on said power delivery shaft exterior to said stator enclosure.

4. The rotary piston mechanism of claim 1 wherein maximum radius of curvature of any portion of a periphery of said elliptic plates is less than a radius of curvature of an inside circular boundary wall of said floating outer ring.

5. The rotary piston mechanism of claim 1 wherein said internal ring is attached to said power delivery shaft.

6. The rotary piston mechanism of claim 5 wherein said internal ring has a circular configuration, an outer circumference of which is one half the perimeter of said elliptic plates.

7. The rotary piston mechanism of claim 1 wherein intermeshing gears exterior to said stator enclosure and interactive between said power delivery shaft and the axles of said elliptic plates ensure accuracy of the rotational motion of said rotor components and the pressure of said rolling contact.

8. The rotary piston mechanism of claim 7 wherein the axles of said elliptic plates are hollow and contain means for compensating for torsional effects caused by eccentric motions.

* * * * *